US005505146A

United States Patent [19]

Laursen

[11] Patent Number: 5,505,146

[45] Date of Patent: Apr. 9, 1996

[54] BURNER PATTERN TO MINIMIZE SIDEWALL CORROSION POTENTIAL

[75] Inventor: Thomas A. Laursen, Canton, Ohio

[73] Assignee: The Babcock & Wilcox Company, New Orleans, La.

[21] Appl. No.: 433,635

[22] Filed: May 2, 1995

[51] Int. Cl.[6] ..... F23D 1/02

[52] U.S. Cl. ..... 110/264; 110/263; 110/265; 431/174; 431/178; 431/179; 431/180

[58] Field of Search ..... 110/263, 264, 110/265, 347; 431/174, 175, 176, 178, 179, 180

[56] References Cited

U.S. PATENT DOCUMENTS 5,205,226 4/1993 Kitto, Jr. et al. ..... 110/264

OTHER PUBLICATIONS

LaRue, A. D. & Rodgers, L. W., "Development of Low–$NO_x$ Cell Burners for Retrofit Applications", presented at the 1985 EPA/EPRI Joint Symposium on Stationary Combustion $NO_x$ Control, Boston, Mass., May 6–9, 1985. Entire paper.

LaRue, A. D.; Laursen, T. A.; Maringo, G. J.; Perry, D. M.; Duong, H. & Newell, R. J., "Update on B&W Low $NO_x$ Combustion Systems", presented at the International Joint Power Generation Conference, San Diego, Calif., Oct. 6–10, 1991. Entire paper.

Kleisley, R. J.; Laursen, T. A.; Maringo, G. J.; Piepho, J. M.; Yagiela, A. S.; Duong, H. V.; Newell, R. J., "Preliminary Results from Phase II, Group II Low $NO_x$ Clean–Coal Retrofit Demonstrations", presented at the Air & Waste Managemet Assocation 85th Annual Meeting & Exhibition, Kansas City, Mo., Jun. 21–26, 1992. 13 pages.

Laursen, T. A. & Duong, H. V., "Application of Low $NO_x$ Cell™ Burners at Dayton Power & Light's J. M. Stuart Station Unit No. 4", presented at the EPRI Workshop on $NO_x$ Controls for Utility Boilers, Cambridge, Mass., Jul. 7–9, 1992. 9 pages.

Kleisley, R. J.; Laursen, T. A.; Latham, C. E. ; Bellanca, C. P.; Duong, H. V. & Moore, D. A. , "Full Scale Demonstration of Low $NO_x$ Cell™ Burners at Dayton Power & Light's J. M. Stuart Station Unit No. 4", presented at the DOE—Clean Coal Technology 1st Annual Clean Coal Technology Conference, Cleveland, Oh., Sep. 22–24, 1992. Entire paper.

Latham, C. E.; Laursen, T. A. & Duong, H. V., "Application of Numerical Modeling in a Clean Coal Demonstration Project", presented at the 1992 International Joint Power Conference, Atlanta, Ga., Oct. 18–22, 1992.

Cioffi, P. L.; LaRue, A. D.; Piepho, J. M. & Waanders, P., "Seven Different Low–$No_x$ Strategies Move from Demonstration to Commercial Status", presented at Power–Gen '92, Orlando, Fla., Nov. 19, 1992. Entire paper.

Bellanca, C. P. & Laursen, T. A., "Low $NO_x$ Burner Demonstartion Project, A Utility Perspective", presented at the Kentucky Coal Utilization Conference, Lexington, Ky., Apr. 13–15, 1993. 14 pages.

Akan–Etuk, A.; Eckhart, C. F.; Kung, S. C.; Bellanca, C. P.; Duong, H. V.; Moore, D. A., "Low $NO_x$ Cell™ Burners for Emissions Control: Benefits from Burner Adjustments", presented at the 18th International Technical Conference on Coal Utilization and Fuel Systems, Clearwater, Fla., Apr. 25–29, 1993. 20 pages.

(List continued on next page.)

*Primary Examiner*—Noah P. Kamen

*Attorney, Agent, or Firm*—Robert J. Edwards; Eric Marich

[57] ABSTRACT

A burner system for a furnace includes horizontal rows of cell burners some of which contain a secondary air port vertically spaced from a coal nozzle. The cell burners are in the front and rear walls of the furnace. Near the side walls of the furnace, which are connected between the front and rear walls, additional double-burner cells are provided which include a pair of vertically spaced coal nozzles or burners. Either a single lower row or a lower and upper row of cell burners include the double-burner cells at the side walls. The double cell burners are operated at 1.0 or higher throat stoichiometry. This reduces corrosion at the side walls while only slightly increasing $NO_x$ emission.

18 Claims, 2 Drawing Sheets

OTHER PUBLICATIONS

Laursen, T. A., et al., "Results of the Low $NO_x$ Cell™ Burner Demonstration at Dayton Power & Light Company's J. M. Stuart Station Unit No. 4, "presented at the 1993 EPRI/EPA Joint Symposium on Stationary Combustion $NO_x$ Control, Miami, Fla., May 23–27, 1993. 6 pages.

Yagiela, A. S., et al., "Results of Babcock & Wilcox's Clean Coal Technology Combustion Modification Projects: Coal reburning for Cyclone Boiler $NO_x$ Control and Low $NO_x$ Cell™ Burner Demonstrations", presented at the DOE–Clean Coal Technology, 2nd Annual Clean Coal Technology Conference, Atlanta, Ga., Sep. 7–9, 1993. 34 pages.

Yagiela, A. S., et al., "Status of Babcock & Wilcox's Clean Coal Technology Combustion Modification Projects: Coal Reburning for Cyclone Boiler $NO_x$ Control and Low $NO_x$ Cell™ Burner Demonstrations", presented at the Third Annual Clean Coal Technology Conference, Chicago, Ill., Sep. 6–8, 1994. 27 pages.

Latham, C. E., et al., "Comparison of Model Predictions with Full–Scale Utility Boiler Data", presented at the 1994 International Joint Power Generation Conference, Phoenix, Az., Oct. 3–5, 1994, 13 pages.

Bellanca, C. P., "Low $NO_x$ Cell Burner Retrofit Clean Coal III Demonstration at J. M. Stuart—Unit 4", presented at EEI Prime Movers Committee, Wash., D.C., Oct. 25, 1994. 17 pages.

Latham, C. E.; LaRue, A. D. & LaRose, J. A., "Designing Air Staging Systems with Mathematical Modeling", presented at the Pacific Rim International Conference on Environmental Control of Combustion Processes, Maui, Hi., Oct. 16–20, 1994. 20 pages.

Laursen, T. A. & Piepho, J. M., "Low $NO_x$ Options for Group II Cell–Fired Boilers", presented at the Air & Waste Management Association's Symposium on Acid Rain & Electric Utilities: Permits, Allowances, Monitoring & Meterology, Tempe, Az., Jan. 23–25, 1995. 5 pages.

Eckhart et al., "Full–Scale Demonstration of Low $NO_x$ Cell Burner Retrofit Preliminary Draft Final Report", DOE/PC/90545–2 (B&W Report No. RDD94:40090–030–037:01). Jul. 1994. 97 pages.

BURNER PATTERN TO MINIMIZE SIDEWALL CORROSION POTENTIAL

FIELD AND BACKGROUND OF THE INVENTION

The present invention relates, in general, to low $NO_x$ burners in large utility boilers, and in particular, to a new and useful cell burner arrangement which uses twin burner cells at the corners of a furnace.

One category of prior art concerns The Babcock & Wilcox Company's (B&W's) pulverized coal cell burners. Cell burners were used on B&W Universal Pressure (UP) Utility Boilers in the 1960's and 1970's as a compact burner design capable of high heat inputs and high combustion efficiency. The closely-spaced paired burner throats (typically on 4'6" vertical center-line spacings) known as cells provide high turbulence and rapid mixing between the pulverized coal and secondary air resulting in relatively high $NO_x$ generation. Cell burners produce little air resistance and poor air distribution between the cells resulting in localized reducing zones in the furnace which leads to furnace wall tube corrosion and slagging problems. Often the air registers are fixed in position, and the airflow patterns within the open, wraparound windboxes tend to feed more secondary air to the burners at the center of the unit, and less air to those cells adjacent to the sidewalls. Cell burners for the largest UP boilers are arranged in two rows on each of the front and rear walls, and are 10 to 14 burner columns wide.

A second category of prior art concerns B&W's S-type burner or any other type of single secondary air zone burner. The S-type burners is a single secondary air zone burner, and its adjustable sliding air damper was designed to facilitate balancing of secondary air flow in multiple burner, open windbox applications. Although not designed to meet EPA $NO_x$ emission limitations, this burner gives the operator the tools to evenly distribute secondary air flow across all the burners of the boiler to minimize furnace waterwall corrosion potential as well as furnace slagging problems. The convertible S-burner was developed as a variation of the S-burner concept, with design features intended to simplify and reduce the cost of conversion to LNCB® technology in the future.

A third category of prior art concerns B&W's DRB-XCL® burner or any other type of dual air zone burner designed for internal air staging with the intent of lowering $NO_x$ emissions. The DRB-XCL burner is designed with an adjustable sliding air damper for secondary air flow balancing in multiple burner, open windbox applications. Other dual air zone burner designs have secondary air flow control dampers or registers to facilitate air flow balancing between the burners.

A fourth category of prior art concerns B&W's Low $No_x$ Cell burner (LNCB®) technology as embodied in B&W's U.S. Pat. No. 5,205,226 which is incorporated herein by reference. This patent covers a low $NO_x$ burner system using an arrangement of B&W's S-burners with enlarged coal nozzles and integral louver-type $NO_x$ ports in inverted and non-inverted arrangements. This LNCB® equipment is designed as a "plug-in" retrofit which fits into the existing cell throat openings. The various arrangement patterns described in the patent were intended to reduce carbon monoxide (CO) and hydrogen sulfide ($H_2S$) concentrations in the lower hopper and burner zone regions of the furnace while maintaining low $NO_x$ emissions. Both the high fuel input S-burner and close coupled $NO_x$ ports are equipped with sliding air dampers for secondary air flow balancing between each throat opening across the boiler within the open windbox.

The subject matter of B&W's Low-$NO_x$ Cell burner disclosed in U.S. Pat. No. 5,205,226 has been cited as "one of the most technologically significant new products of the year" and was selected to receive the coveted 1994 R&D 100 Award. Sharing the award with B&W were the Electric Power Research Institute, the Department of Energy (DOE), the Ohio Coal Development Office within the Ohio Department of Development, and the Dayton Power & Light Company.

The arrangements described in the patent minimize the areas of the furnace waterwalls which are exposed to reducing combustion gases. However, the inherent operation of the high input S-burners at sub-stoichiometric conditions leave the potential for reducing furnace gas conditions along the sidewalls at the burner elevations and above until the secondary air from the close coupled $NO_x$ port oxidizes these furnace gases. This could potentially lead to localized elevated corrosion rates in these waterwall areas requiring some form of corrosion protection, including but not limited to field applied corrosion-resistant coatings. The LNCB® technology was developed as a plug-in low $NO_x$ solution for cell equipped boilers without resorting to pressure part modifications.

A fifth category of prior art concerns the B&W pulverized coal fired, cell burner equipped universal pressure (UP) boiler. In particular, the 1100 MW to 1300 MW class of supercritical pressure UP boilers with 10, 11, 12, or 14 burner columns across the width of the unit. This type of boiler is the focus of the present invention.

Two 1100 MW units at Duke Power's Belews Creek Units 1 & 2 (B&W designation UP-95 and UP-96), are currently equipped with convertible S-burners and are 10 burner columns wide (40 cells). Two 1300 MW units at TVA's Cumberland Units 1 & 2 (B&W designation UP-73 and UP-81), still have the original cell burners and are 11 burner columns wide (44 cells). Two 1300 MW units at AEP's Gavin Units 1 & 2 (B&W designation UP-102 and UP-107), still have the original cell burners and are 14 burner columns wide (56 cells). One 1300 MW unit at AEP's Amos Unit 3 (B&W designation UP-101), still has the original cell burners and is 12 burner columns wide (48 cells).

The higher operating pressures and temperatures of the supercritical fluid in the lower furnace first and second pass waterwall circuits, produce high furnace waterwall tube surface metal temperatures. Corrosion studies have shown that corrosion rates increase with increasing metal temperature. Therefore, supercritical UP boilers are more susceptible to furnace waterwall corrosion than drum type boilers equipped with the same furnace tube material and exposed to the same combustion environment.

SUMMARY OF THE INVENTION

The present invention uses eight (8) conventional single air zone burners or eight (8) dual zone low $NO_x$ burners of the type shown in U.S. Pat. No. 5,205,226, in the lower row cells located adjacent the sidewalls of a furnace. Alternatively, sixteen (16) conventional single air zone or dual air zone low $NO_x$ burners are used in the lower and upper row cells located adjacent the sidewalls, while providing LNCB® equipment in the remainder of the furnace. For these types of units already equipped with convertible S-burners, the 8 or 16 corner burners would remain as convertible S-burners. By balancing secondary air with the individual burner air dampers so that these burners adjacent to the sidewalls operate at a throat stoichiometry of 1.0 or greater, this invention addresses utility customers' concerns regarding sidewall corrosion potential on UP (Universal Pressure, once-through) boilers with LNCB® equipment. By operating the burners adjacent each sidewall at a stoichiometry of 1.0 or greater, the potential for sidewall corrosion is decreased since the environment along the sidewalls will be in an oxidizing condition, thereby hindering the formation of hydrogen sulfide, which is the precursor of the furnace waterwall corrosion mechanism. Since these larger UP boilers are 10–14 burner columns wide (40 to 56 cells each), retaining 4 or 8 cells at above stoichiometric conditions will raise overall $NO_x$ emissions only slightly as compared to a full LNCB® equipment retrofit.

LNCB® equipment, single air zone burners, and dual air zone burners have proven reliability records in operating UP boilers. The inventive arrangement combines LNCB equipment with other proven burner equipment within the same furnace. Secondary air flow balancing and primary air/coal line balancing may be more challenging with this combination.

The pattern of the invention maintains the low installed cost of LNCB® technology for cell-equipped units, requiring no pressure part modifications. The potential for sidewall corrosion is decreased since the burners located adjacent the sidewalls can be operated at throat stoichiometries of 1.0 or greater, thereby minimizing the possibility of the sidewall tube material being exposed to reducing furnace gas conditions.

The arrangement has a minimal increase in overall $NO_x$ emissions as compared to a full unit LNCB retrofit since only a small fraction of the total fuel input (7% to 20%) would be at a throat stoichiometry greater than 1.0. This arrangement could also provide slightly better carbon burnout along these relatively cooler sidewall burner columns since the throat stoichiometry will be maintained above 1.0. The invention is a particularly attractive alternative for these types of supercritical UP boilers which are susceptible to sidewall corrosion due to high furnace tubewall operating temperatures.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which preferred embodiments of the invention are illustrated.

DESCRIPTION OF THE PREFERRED EMBODIMENTS

Figure 1:
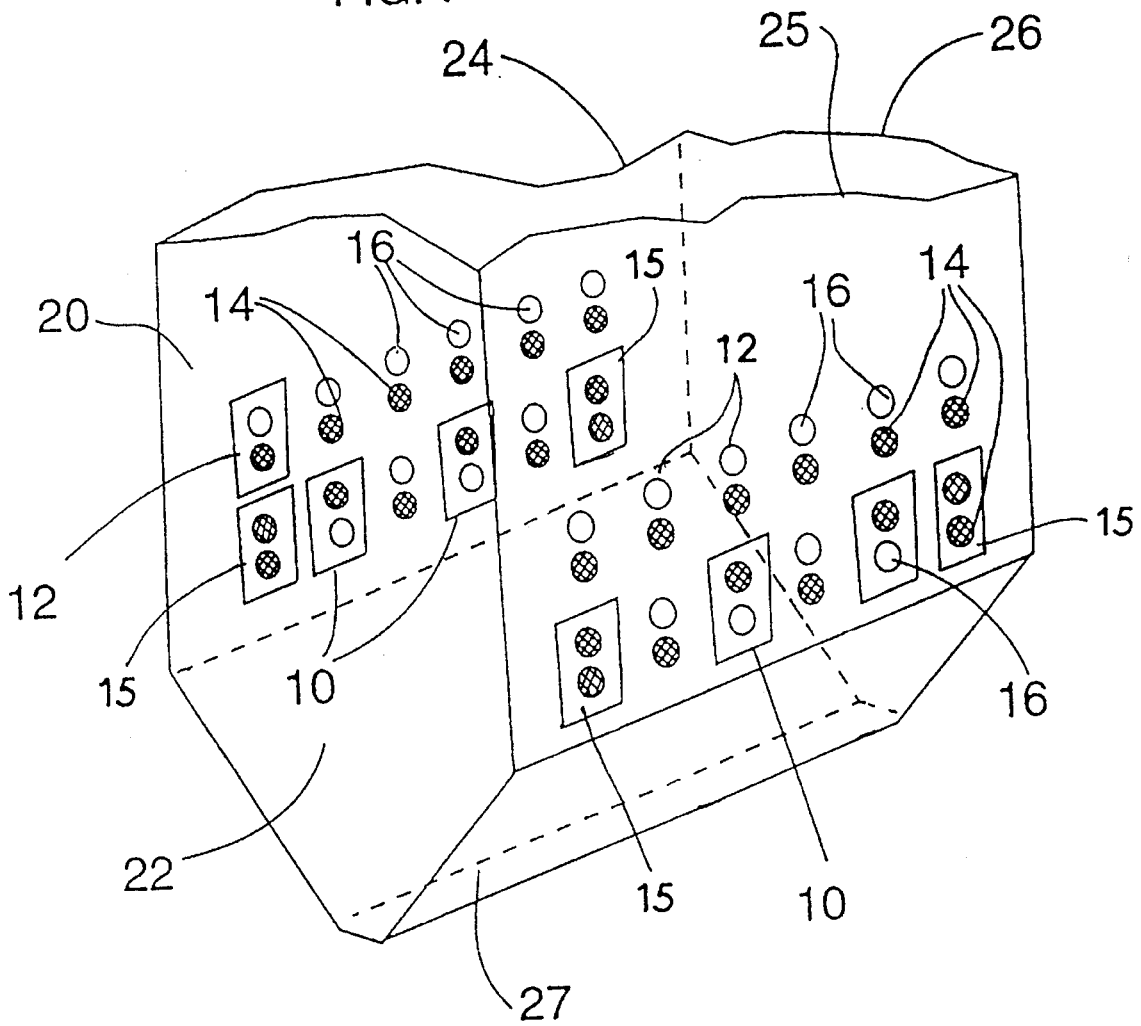
FIG. 1 is a schematic perspective view of a utility boiler furnace utilizing multiple cells in the system of the present invention.
Figure 2:
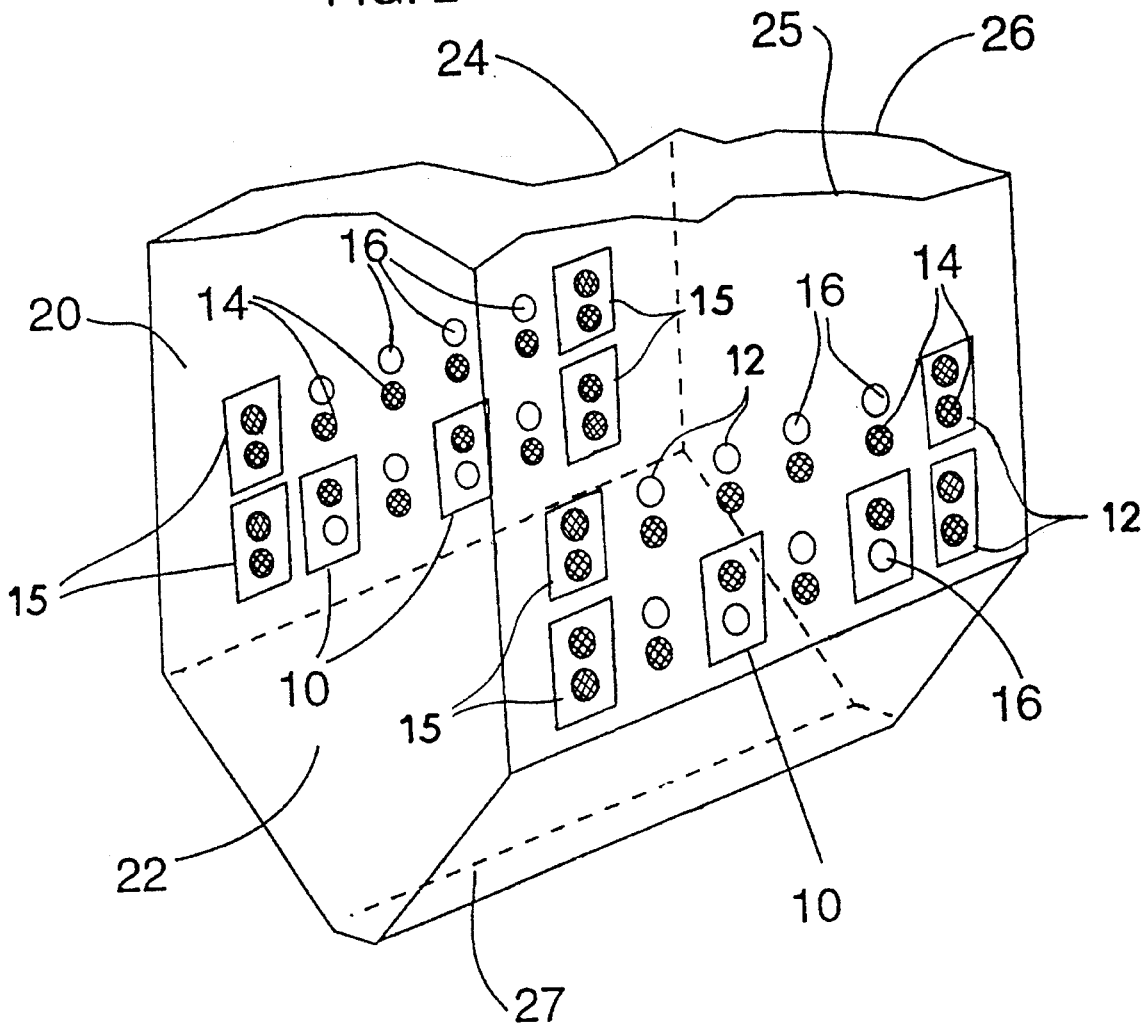
FIG. 2 is a view similar to FIG. 1 of another embodiment of the invention.

Referring to the drawings in particular wherein like numerals designate the same or functionally similar elements in both drawings, the invention embodied in FIGS. 1 and 2 comprises a low $NO_x$ burner system comprising some inverted low $NO_x$ burner cells 10, used in conjunction with non-inverted cells 12, servicing a boiler, for example, a large utility boiler, having a furnace 20. Most of the cells include a single coal burner or coal nozzle 14 which is mounted either below (in the non-inverted cell) or above (in the inverted cell) a secondary air port 16 used to provide secondary air in the immediate vicinity of the flame discharged from the burner 14. The secondary air nozzles 16 are each shown as open circles while the coal burners 14 are shown as hatched circles.

Furnace 20 comprises a rear wall 24, a front wall 25 and a pair of opposite side walls 26. Furnace hopper 22 includes a throat or opening 27.

Excess secondary air can be supplied in the hopper throat or opening 27. A pattern of non-inverted cells 12 can be utilized; for example, and as shown in FIGS. 1 and 2, 12 cells in two vertically spaced horizontal rows are applied to the front and rear walls (25, 24 respectively) for directing coal fired flames into the furnace 20. The inverted pattern for one or more cells in each row of cells, to be described in connection with FIGS. 1 and 2, can be used as either the upper, lower or both rows, replacing the non-inverted cells.

As shown in FIG. 1, one arrangement of inverted cells alternates between inverted and non-inverted cells across the lower row of cells only in the rear and front walls 24, 25. Each inverted cell 10 on the front wall 25 faces directly opposite a non-inverted cell 12 on the rear wall 24. This arrangement has been found to advantageously circulate secondary air in the hopper and lower furnace portion of the boiler, to minimize $NO_x$ generation as well as reduce CO and $H_2S$ production.

In accordance with the present invention, FIG. 1 illustrates cells 15 at each of the corners of the furnace 20, adjacent each of the side walls 26, comprising a double-burner cell having a pair of vertically spaced burners 14, rather than a burner plus secondary air port combination. In the embodiment of FIG. 1, eight burners 14 are provided near the side walls 26 and in the lower row of cells while in the embodiment of FIG. 2, sixteen burners are provided near the side walls 26, occupying positions in both the bottom and top rows of cells. However, if reducing conditions/corrosion is observed only at corners near the front wall 25, or only near the rear wall 24, it is possible to use the double-burner cells only at these locations and operated as described.

While specific embodiments of the invention have been shown and described in detail to illustrate the application of the principles of the invention, it will be understood that the invention may be embodied otherwise without departing from such principles.

I claim:

1. A burner system for a furnace having spaced apart front and rear walls connected between spaced apart side walls, the system comprising:

a plurality of cell burners lying along at least one horizontal row in at least one of the front and rear walls, each cell comprising a coal nozzle for projecting a primary air plus coal mixture into the furnace, and a secondary air port spaced vertically from the coal nozzle for supplying secondary air into the furnace at a vertically spaced yet adjacent location to the primary air plus coal mixture supplied to the furnace;

means for supplying primary air and coal to the coal nozzles;

means for supplying secondary air to the secondary air ports; and a double-burner cell in each of the front and rear walls and adjacent each of the side walls, each double-burner cell including a pair of spaced apart coal nozzles for projecting a primary air plus coal mixture into the furnace.

2. A system according to claim 1, wherein at least some of the coal nozzles in at least some of the double-burner cells comprise single air zone burners.

3. A system according to claim 1, wherein at least some of the coal nozzles in at least some of the double-burner cells comprise dual air zone low $NO_x$ burners.

4. A system according to claim 1, wherein the coal nozzles of the double-burner cells include means for operation at a throat stoichiometry of 1.0 or greater.

5. A system according to claim 1, wherein at least some of the cell burners are non-inverted cell burners with the secondary air port spaced above the coal nozzle, and at least some of the cell burners are inverted cell burners with the secondary air port below the coal nozzle.

6. A system according to claim 1, including at least two vertically spaced rows each containing a plurality of cell burners with the double-burner cells being at least in the lower row.

7. A system according to claim 6, including double-burner cells in each of the at least two rows, and in the front and rear walls adjacent each of the side walls.

8. A system according to claim 1, including means for supplying from 7% to 20% a total amount of fuel for the furnace to the double-burner cells, the double-burner cells being operated at a throat stoichiometry which is greater than 1.0.

9. A system according to claim 1, including from 40 to 56 cell burners and from 4 to 8 double-burner cells in the furnace.

10. A burner system for a furnace having spaced apart front and rear walls connected between spaced apart side walls, the system comprising:

a plurality of cell burners lying along at least one horizontal row in at least one of the front and rear walls, each cell comprising a coal nozzle for projecting a primary air plus coal mixture into the furnace, and a secondary air port spaced vertically from the coal nozzle for supplying secondary air into the furnace at a vertically spaced yet adjacent location to the primary air plus coal mixture supplied to the furnace;

means for supplying primary air and coal to the coal nozzles;

means for supplying secondary air to the secondary air ports; and a double-burner cell in at least one of the front and rear walls and adjacent each of the side walls, each double-burner cell including a pair of spaced apart coal nozzles for projecting a primary air plus coal mixture into the furnace.

11. A system according to claim 10, wherein at least some of the coal nozzles in at least some of the double-burner cells comprise single air zone burners.

12. A system according to claim 10, wherein at least some of the coal nozzles in at least some of the double-burner cells comprise dual air zone low $NO_x$ burners.

13. A system according to claim 10, wherein the coal nozzles of the double-burner cells include means for operation at a throat stoichiometry of 1.0 or greater.

14. A system according to claim 10, wherein at least some of the cell burners are non-inverted cell burners with the secondary air port spaced above the coal nozzle, and at least some of the cell burners are inverted cell burners with the secondary air port below the coal nozzle.

15. A system according to claim 10, including at least two vertically spaced rows each containing a plurality of cell burners with the double-burner cells being at least in the lower row.

16. A system according to claim 15, including double-burner cells in each of the at least two rows, and in the front and rear walls adjacent each of the side walls.

17. A system according to claim 10, including means for supplying from 7% to 20% a total amount of fuel for the furnace to the double-burner cells, the double-burner cells being operated at a throat stoichiometry which is greater than 1.0.

18. A system according to claim 10, including from 40 to 56 cell burners and from 4 to 8 double-burner cells in the furnace.

* * * * *